United States Patent [19]

Kato et al.

[11] Patent Number: 5,043,241

[45] Date of Patent: Aug. 27, 1991

[54] LIQUID DEVELOPER FOR ELECTROSTATIC PHOTOGRAPHY

[75] Inventors: Eiichi Kato; Kazuo Ishii, both of Shizuoka, Japan

[73] Assignee: Fuji Photo Film Co., Ltd., Kanagawa, Japan

[21] Appl. No.: 427,392

[22] Filed: Oct. 27, 1989

[30] Foreign Application Priority Data

Oct. 27, 1988 [JP] Japan ..... 63-269469

[51] Int. Cl.[5] ..... G03G 9/12

[52] U.S. Cl. ..... 430/114; 430/119; 430/904

[58] Field of Search ..... 430/119, 114, 137

[56] References Cited

U.S. PATENT DOCUMENTS 4,579,803 4/1986 Kato et al. ..... 430/14
4,837,102 6/1989 Dan et al. ..... 430/137
4,842,975 6/1989 Kato et al. ..... 430/137

FOREIGN PATENT DOCUMENTS 3701487 6/1987 Fed. Rep. of Germany .
3730288 7/1988 Fed. Rep. of Germany .
2186095 5/1987 United Kingdom .

*Primary Examiner*—John Goodrow

*Attorney, Agent, or Firm*—Sughrue, Mion, Zinn Macpeak & Seas

[57] ABSTRACT

A liquid developing agent comprising a resin dispersed in a nonaqueous solvent wherein said comprise copolymer resin grains produced by polymerization of a solution containing one monofunctional monomer (a) which is soluble in said nonaqueous solvent but is rendered insoluble by polymerization and at least one monomer (B) which contains at least two polar groups and/or polar linkage groups and is represented by

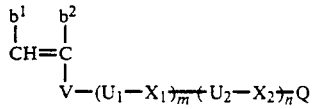

(II)

in the presence of a resin for dispersion stabilization which is soluble in said nonaquous solvent and is a polymer which has repeating units represented by the general formula (I) below

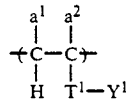

(I)

7 Claims, No Drawings

LIQUID DEVELOPER FOR ELECTROSTATIC PHOTOGRAPHY

FIELD OF THE INVENTION

The present invention relates to a liquid developer for electrostatic photography in which at least a resin is dispersed in a carrier solution with an electrical resistance of $10^9$ Ω cm or more and a dielectric constant of 3.5 or less. More particularly, this invention relates to a liquid developer which has excellent re-dispersibility, storability, stability, image reproduction characteristics and fixing characteristics.

BACKGROUND OF THE INVENTION

Conventional liquid developer for electro photography are agents in which an organic or inorganic pigment or dye such as carbon black, nigrosine or phthalocyanine blue, etc. and a natural or synthetic resin such as an alkyd resin, an acrylic resin, rosin or a synthetic rubber, etc., are dispersed in an aliphatic petroleum hydrocarbon or similar highly electrically insulating, low dielectric constant liquid and with additionally polarity control agent such as a metal soap, lecithin, linseed oil, a higher fatty acid or vinyl pyrrolidone, etc.

The resin in these types of developer is dispersed in the form of insoluble latex grains with a diameter of several nm - several hundred nm. In a conventional liquid developer, since the bonding between the latex particles which are insoluble in the liquid developer and a dispersion stabilization resin or the polarity control agent which are soluble in the agent is imperfect, the soluble dispersion stabilization resin and the polarity control agent are in a form in which they are easily dispersed in the solution. As a result, there is the drawback that on long-term storage or repeated use the soluble dispersion stabilization resin becomes detached from the insoluble latex grains, the grains precipitate, aggregate and accumulate and the polarity becomes unclear. Further, since it is difficult to redisperse the grains once they have aggregated and accumulated, the grains adhere all over to the development unit, and this leads to damage to the image portions and to development unit problems such as solution feed pump blockage, etc.

A means for achieving chemical bonding of the soluble dispersion stabilization resin and insoluble latex grains in order to minimize this drawback is disclosed in U.S. Pat. No. 3,990,980. However, although the dispersion stability as to natural precipitation of grains is improved to some extent in such a liquid developer, the improvement is still unsatisfactory. Moreover, when the developer is put into and used in an actual development apparatus there are the drawbacks that toner adhering to various portions of the apparatus hardens as a film, redispersion is difficult and apparatus malfunction and fouling of images, etc. occur. Further, there is insufficient redispersion stability for practical purposes. In addition, in manufacturing the above-noted resin grains, if monodisperse grains with a narrow grain size distribution are to be produced, there are great restrictions in terms of the combinations of dispersion stabilization agents and insolubilized monomers that can be used and generally grains with a broad grain size distribution containing a large amount of coarse grains or polydisperse grains in which two or more average grain diameters are present are produced. Also, since it is difficult to achieve the desired average grain size in monodisperse grains with a narrow grain size distribution, large grains of 1 μm or more or very fine grains of 0.1 μm or less are formed. Problems occur in that the dispersion stabilization agents used have to be manufactured using complicated and time-consuming manufacturing steps.

To eliminate these drawbacks, methods in which the degree of dispersion, re-dispersibility and storage stability of grains are improved by using insoluble dispersion resin grains in the form of copolymers of monomers that are insolubilized and monomers containing long-chain alkyl portions or monomers containing two or more polar components are disclosed in, e.g., JP-A-60-179751 and JP-A-62-151868 (the term "JP-A" as used herein means an "unexamined published Japanese patent application"). Also, methods for improving the degree of dispersion, re-dispersibility and storage stability of grains by using insoluble dispersion resin grains in the form of copolymers of monomers containing long-chain alkyl portions and monomers that are insolubilized in the presence of polymers for which bifunctional monomers have been used or polymers for which a macromolecular reaction has been used are disclosed in, e.g., JP-A-62-166362 and JP-A-63-66567.

Furthermore, recently, methods of printing a large number of sheets, for example, 5,000 or more, using a master plate for offset printing by an electro photographic system have been attempted and particular advances have been made in improvements of master plates with the result that it has become possible to print 10,000 or more large-size sheets. Progress has also been made in connection with shortening of operation time in electrophotographic plate making systems and improvements have been made in speeding-up of the development - fixing stages.

With dispersed resin grains manufactured by the means disclosed in the above-noted JP-A-60-179751, JP-A-62-151868, JP-A-62-166362 and JP-A-63-66567, there is still failure in always achieving satisfactory performance in terms of dispersibility and re-dispersibility of the grains when the speed of development is increased or in terms of printing resistance in the case of large-size (e.g., size A3 or larger) master plates or with shortened fixing times.

SUMMARY OF THE INVENTION

The present invention overcomes the above-noted problems of conventional liquid developer.

An object of this invention is to provide a liquid developer having excellent dispersion stability, redispersibility and fixing characteristics even in an electrophotographic plate making system in which the development - fixing processes are speeded up and largesize master plates are used.

Another object of this invention is to provide a liquid developer which permits production of offset printing negative plates with excellent printing ink receptivity and printing durability (printing press life).

A further object of this invention is to provide a liquid developer which, in addition to the above-noted applications, is suitable for various types of electrostatic photography and various types of transfer applications.

Yet another object of this invention is to provide a liquid developer which is employable in all systems using liquid developer such as systems for ink jet recording, cathode ray tube recording and pressure change, static electricity change or similar change recording.

The objects of this invention are achieved by a liquid developer for electrostatic photography comprising at least one resin dispersed in a nonaqueous solvent with an electrical resistance of $10^9$ Ω cm or more and dielectric constant of 3.5 or less, wherein the dispersed resin grains are copolymer resin grains produced by polymerization of a solution containing at least one monofunctional monomer (A) which is soluble in the nonaqueous solvent but is rendered insoluble by polymerization and at least one monomer (B) which contains at least two polor groups and/or polor linkage groups and which is represented by the general formula (II) below;

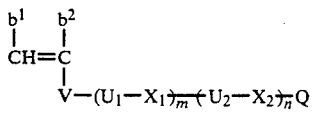

(II)

wherein, V represents —O—, —COO—, —OCO—, —$CH_2OCO$—, —$SO_2$—, —CONH—, —$SO_2NH$—,

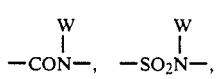

where W represents a hydrocarbon group or has the same meaning as the linkage group:

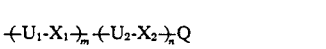

in general formula (II),

Q represents a hydrogen atom, or a hydrocarbon group having 1 to 18 carbon atoms optionally substituted with a halogen atom, —OH, —CN, —$NH_2$, —COOH, —$SO_3H$ or $PO_3H_2$;

$X_1$ and $X_2$, wherein may be the same or different, each represents —O—, —S—, —CO—, —$CO_2$—, —OCO—, —$SO_2$-,

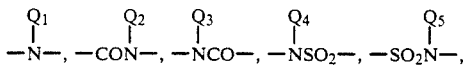

$NHCO_2$— or —NHCONH— where $Q_1$, $Q_2$, $Q_3$, $Q_4$ and $Q_5$ have the same meaning as Q;

$U_1$ and $U_2$, which may be the same or different each represents a hydrocarbon group having 1 to 18 carbon atoms which may be substituted or have a

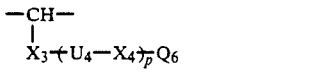

group inserted in a main chain bond, where $X_3$ and $X_4$, which may be the same or different, each have the same measuring as $X_1$ and $X_2$ noted above, $U_4$ indicates an optionally substituted hydrocarbon group having 1 to 18 carbon atoms and $Q_6$ has the same meaning as Q;

$b^1$ and $b^2$, which may be the same or different, each represents a hydrogen atom, a hydrocarbon group, —COO—L or —COO—L— linked via a hydrocarbon, where L represents a hydrogen atom or an optionally substituted hydrocarbon group; and m, n and p, which may be the same or different, each represents an integer of 0 to 4;

in the presence of a resin for dispersion stabilization which is soluble in the non-aqueous solvent and is a polymer which has repeating units represented by the general formula (I) below;

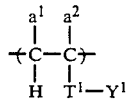

(I)

Wherein, $T^1$ represents —COO—, —OCO—, —$CH_2$-oCO—, —$CH_2COO$—, —O— or —$SO_2$; and $Y^1$ represents an aliphatic group having 6 to 32 carbon atoms, and $a^1$ and $a^2$, which may be the same or different, each represents a hydrogen atom, a halogen atom, a cyano group, a hydrocarbon group having 1-8 carbon atoms, —COO—$Z^1$ or —COO—$Z^1$ linked via a hydrocarbon group having 1 to 8 carbon atoms and where $Z^1$ represents a hydrocarbon group having 1 to 22 carbon atoms;

a portion of which is crosslinked and in which an acidic group selected from the group consisting of —$PO_3H_2$, —$SO_3H$, —COOH, —OH, —SH and

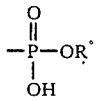

groups, where R° represents a hydrocarbon group, is bonded to only one terminal of at least one polymer main chain.

DETAILED DESCRIPTIONS OF THE INVENTION

A detailed description of the liquid developing agent of the invention is given in the following.

Straight chain or branched aliphatic, alicyclic or aromatic hydrocarbons or halogen substituted derivatives were employed, preferably, as the carrier solution with an electrical resistance of $10^9$ Ω cm or more and a dielectric constant of 3.5 or less used in this invention. For example, suitable solvents include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: tradename of the Exxon Corporation), Shellsol 70, Shellsol 71 (Shellsol: tradename of Shell Oil Company), Amsco OMS or Amsco 460 (Amsco: tradename of the Spirits Company) and these may be used alone or as a mixture thereof.

The nonaqueous dispersion resin grains which are an important constituent element in the present invention (and which are sometimes called 'latex grains' hereinafter) are manufactured by polymerization and granulation through copolymerization of a monofunctional monomer (A) and a monomer (B) which contains at least two polar groups and/or polar linkage groups in a nonaqueous solvent, in the presence of a resin for dispersion stabilization that is a polymer which has repeating units representable by the above-noted general formula (I), a portion of which is crosslinked and in which an acidic group selected from the group consisting of —$PO_3H_2$, —$SO_3H$, —COOH, —OH, —SH and

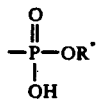

groups, where R° represents a hydrocarbon group, is bonded to only one end or terminal of at least one polymer main chain.

Basically, as long as it is miscible with the carrier solution of the above-noted electrostatic photographic developing agent, any material may be used as the nonaqueous solvent here.

That is, as long as the solvent used during manufacture of the dispersion resin grains is miscible with the carrier solution, it is suitable materials which may be employed for this purpose include straight chain or branched aliphatic, alicyclic or aromatic hydrocarbons or halogen substituted derivatives thereof. For example, the solvents such as hexane, octane, isooctane, decane, isodecane, decalin, nonane, dodecane, isododecane, Isopar E, Isopar G, Isopar H, Isopar L, Shellsol 70, Shellsol 71, Amsco OMS and Amsco 460 may be used alone or as a mixture.

Examples of suitable solvents that can be used together with these organic solvents include alcohols (e.g., methyl alcohol, ethyl alcohol, propyl alcohol, butyl alcohol or fluorinated alcohol), ketones (e.g., acetone, methyl ethyl ketone, cyclohexanone), carboxylic acid esters (e.g., methyl acetate, ethyl acetate, propyl acetate, butyl acetate, methyl propionate, ethyl propionate), ethers (e.g., diethyl ether, dipropyl ether, tetrahydrofuran, dioxane) and hydrocarbon halides (e.g., methylene dichloride, chloroform, carbon tetrachloride, dichloroethane, methyl chloroform).

Preferably, these nonaqueous solvents that are used in admixture are distilled off by heating of distillation under reduced pressure after polymerization and granulation, but even if they are carried into the liquid developing agent there are no problems as to the latex grain dispersion is concerned so long as the resistance of the development solution is $10^9$ Ω cm or more.

Normally, it is better if the solvent used in the resin dispersion manufacturing stage is the same a that used for the carrier solution. Examples of suitable solvents are straight chain or branched aliphatic hydrocarbons, alicyclic hydrocarbons, aromatic hydrocarbons and hydrocarbon halides as noted above.

The dispersion stabilization resin of the invention which is used in order to make the copolymer that is insoluble in the solvent and is produced by copolymerizing a monofunctional monomer (A) and a monomer (B) into a stable resin dispersion in the solvent, is a polymer which is soluble in the nonaqueous solvent, which has repeating units represented by general formula (I), a portion of the polymer chain of which is crosslinked and in which an acidic group selected from the group, consisting of $—PO_3H_2$, $—SO_3H$, —COOH, —OH, —SH and

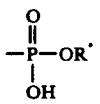

groups, where R° represents a hydrocarbon group, is bonded to only one end of at least one polymer main chain.

A more detailed description of the repeating units represented by general formula (I) is set forth below.

Substitution by aliphatic groups or hydrocarbon groups may be effected in the repeating units represented by general formula (I).

$R^1$ in general formula (I) is preferably —COO—, —OCO—, $—CH_{20}CO—$, $—CH_2COO—$ or —O— and even more preferably —COO—, $—CH_2COO-$ or —O—.

$Y^1$ is preferably an alkyl, alkenyl or aralkyl group having 8 to 22 carbon atoms and it may be substituted. Suitable substituents, e.g., halogen atoms (e.g., fluorine, chlorine, bromine), $—O—Z^2$, $—COO—Z^2$ $—OCO—Z^2$ (where $Z^2$ represents an alkyl group having 6 to 22 carbon atoms, e.g., hexyl, octyl, decyl, dodecyl, hexadecyl, octadecyl). More preferably, Yl is an alkyl group or alkenyl group each having 8 to 22 carbon atoms. Examples thereof include octyl, decyl, dodecyl, tridecyl, tetradecyl, hexadecyl, octadecyl, docosanyl, octenyl, decenyl, dodecenyl, tetradecenyl, hexadecenyl and octadecenyl.

$a^1$ and $a^2$ may be the same or different and are preferably hydrogen atom, halogen atoms (e.g., fluorine, chlorine, bromine), cyano groups, alkyl groups having 1 to 3 carbon atoms, $—COO—Z^1$ or $—CH_2COO—Z^1$ (where $Z^1$ represents an aliphatic group having 1 to 22 carbon atoms, examples of which include methyl, ethyl, propyl, butyl, hexyl, octayl, decyl, dodecyl, tridecyl, tetradecyl, hexadecyl, octadecyl, docosanyl, pentenyl, hexenyl, heptenyl, octenyl, decenyl, dodecenyl, tetradecenyl, hexadecenyl and octadecenyl, and which may possess substituents such as those indicated for $Y^1$ above). Still more preferably $a^1$ and $a^2$ each represent hydrogen atoms, alkyl groups having 1 to 3 carbon atoms (e.g., methyl, ethyl, propyl), $—COO—Z^3$ or $—CH_2COO—Z^3$ (where $Z^3$ represents an alkyl group or alkenyl group having 1 to 12 carbon atoms, e.g., a methyl, ethyl, propyl, butyl, hexyl, octyl, decyl, dodecyl, pentenyl, hexenyl, heptenyl, octenyl or decenyl group, and these alkyl and alkenyl groups may possess substituents such as those indicated for $Y^1$ above).

The dispersion stabilization resin of the invention which is used in order to produce the copolymer that is insoluble in the solvent and is produced by copolymerizing the monomers (A) and (B) into a stable resin dispersion in the solvent, is a resin which does not contain graft groups that polymerize with monomers (A) and (B) and is a polymer which possesses at least one repeating unit represented by general formula (I), a portion of which is crosslinked and which has bonded to only one end of at least one main chain, an acidic group selected from the groups consisting of carboxy, sulfo, phosphono, hydroxyl, mercapto and

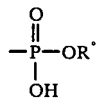

groups, where R° preferably is a hydrocarbon group having 1 to 18 carbon atoms {and more preferably an optionally substituted aliphatic group having 1 to 8 carbon atoms (e.g., methyl, ethyl, propyl, butyl, hexyl, octyl, 2-chloroethyl, 2-methoxyethyl, butenyl, pentenyl, hexenyl, benzyl, phenethyl, bromobenzyl, methoxybenzyl, chlorobenzyl, methylbenzyl, cyclopentyl, cyclohexyl) or an optionally substituted aryl group having 6 to 10 carbon atoms (e.g., phenyl, tolyl, xylyl, chlorophenyl, bromophenyl, methoxyphenyl, ethylphenyl, methoxycarbonylphenyl)}. The acidic group here has a chemical structure whereby it is bonded directly to or via any desired linkage group to one end of the polymer main chain.

Linkage groups comprise groups of any combination of atomic groups which carbon carbon bonds (single or double bonds), carbon heteroatom bonds (examples of heteroatoms including oxygen, sulfur, nitrogen and silicon atoms) and heteroatom heteroatom bonds. Examples include linkage groups, used alone or in any combination, that are selected from

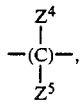

where $Z^4$ and $Z^5$ each represents hydrogen atoms, halogen atoms (e.g., fluorine, chlorine, bromine), cyano groups, hydroxyl groups, alkyl groups (e.g., methyl, ethyl, propyl), —(CH=CH)—,

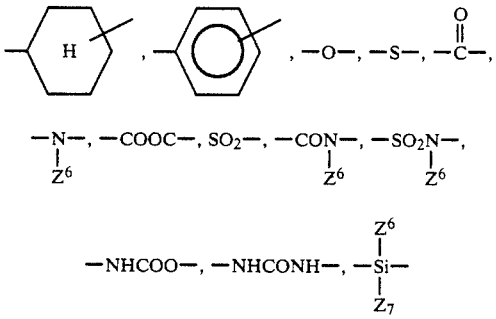

(where $Z^6$ and $Z^7$ each individually represents hydrogen atoms or hydrocarbon groups, etc. having the same meaning as $Z^1$ in general formula (I) noted above).

The polymer components of the dispersion stabilization resin of the invention include homopolymer or copolymer components selected from repeating units represented by general formula (I) and copolymer components produced by polymerization with other monomers that are copolymerizable with monomers corresponding to repeating units represented by general formula (I), and they are polymers of which a portion is crosslinked.

Conventionally known methods may be employed for introducing a crosslinked structure into the polymer. In more detail, methods in which polymerization is effected with polyfunctional monomers introduced into the monomer polymerization reaction and methods in which crosslinking is effected by a macromolecular reaction with inclusion of functional groups which cause a crosslinking reaction to occur can be used.

From the point of view of simplicity of the manufacturing procedure e.g., preventing from taking long reaction time, incorporation of impurities, e.g., due to use of reaction accelerators, non-quantitative procedures, etc, crosslinking reactions by polymerization or using the functional groups —$CONHCH_2OZ^8$ (where $Z^8$ represents a hydrogen atom or an alkyl group) which give rise to self-crosslinking reactions are effective for the dispersion stabilization resin of the invention.

A preferred method for the polymerization reaction is one in which crosslinking between polymer chains is effected through polymerization of monomers possessing two or more polymerizable functional groups with monomers corresponding to the repeating units represented by formula (I) noted above.

Specific examples of polymerizable functional groups that can be used include $CH_2$=CH—, $CH_2$=CH—$CH_2$—,

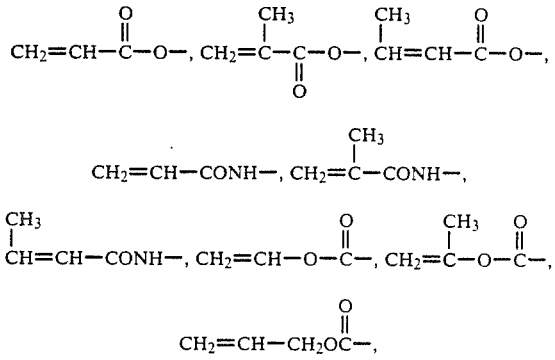

$CH_2$=CH—NHCO—, $CH_2$=CH—$CH_2$—NHCO, $CH_2$=CH—$SO_2$—, $CH_2$=CH—CO—, $CH_2$=CH—O— and $CH_2$=$CH_2$—S-. It is satisfactory if the monomers possessing two or more of the above-mentioned polymerizable functional groups are monomers with two or more of these polymerizable functional groups, which may be the same or different.

Specific examples of suitable monomers possessing two or more polymerizable functional groups include, as monomers with the same polymerizable functional groups, styrene derivatives such as divinyl benzene and trivinyl benzene, etc.; methacrylic, acrylic or crotonic acid esters, vinyl esters or allyl esters, of polyhydric alcohols (e.g., ethylene glycol, diethylene glycol, triethylene glycol, polyethylene glycol #200, #400, #600, 1,3-butylene glycol, neopentyl glycol, dipropylene glycol, polypropylene glycol, trimethylolpropane, trimethylolethane, pentaerythritol), or polyhydroxyphenols (e.g., hydroquinone, resorcinol, catechol or derivatives thereof), vinyl esters or allyl esters, or vinyl amides or allyl amides, of dibasic acids (e.g., malonic, succinic, glutaric, adipic, pimelic, maleic, phthalic or itaconic acid), and condensates of polyamines (e.g., ethylenediamine 1,3-propylenediamine, 1,4-butylenediamine) and carboxylic acids containing vinyl groups (e.g., methacrylic, acrylic, crotonic, or allylacetic acid).

Examples of suitable monomers with different polymerizable functional groups include vinyl-group-containing ester or amide derivatives of carboxylic acids having vinyl groups [e.g., methacrylic, acrylic, methacryloylacetic, acryloylacetic, methacryloylpropionic, acryloylpropionic, itaconyloylacetic or itaconyloylpropionic acid and products of the reaction of alcohols or animals with carboxylic anhydrides (e.g, allyloxycarbonylprop onic acid, allyloxycarbonylacetic acid, 2-alloyxycarbonylbenzoic acid, allylaminocarbonylpropionic acid)] (e.g., vinyl methacrylate, vinyl acrylate, vinyl itaconate, allyl methacrylate, allyl acrylate, allyl itaconate, vinyl methacryloylacetate, vinylmetheacryloylpropionate, allyl methacryloxylpropionate, vinyloxycarbonylmethyl methacrylate, vinyloxycarbonyl methyloxycarbonylethylene acrylate, N-allylacrylamide, N-allymethacrylamide, N-allylitaconic acid amide, methacryloylpropionic acid allyl amide) and vinyl-group-containing ester derivatives or amide derivatives which are derived from condensates of aminoalcohols (e.g., aminoethanol, 1aminopropanol, 1-aminobutanol, 1-aminohexanol, 2-aminobutanol) and vinyl-group-containing carboxylic acids.

The dispersion stabilization resin of this invention that is soluble in the nonaqueous solvent is formed by polymerization with monomers possessing two or more polymerizable functional groups that are used in the invention representing 15 wt % or less and preferably 10 wt % at less of the total monomers.

The dispersion stabilization resin of the invention which is formed by bonding a specific acidic group to only one end of at least one main polymer chain can easily be manufactured by conventional synthesis processes. Examples of known processes include those in which various reagents are reacted at the ends of living polymers produced by anionic or cationic polymerization (processes using an ionic polymerization method), processes in which radical polymerization is effected using chain transfer agents and/or polymerization initiators in which the molecules contain specific acidic groups (processes using the radical polymerization method) or processes in which polymers that are produced by ionic or radical polymerization processes such as above and contain reactive groups at their ends are converted to the specific acidic groups of the invention by a macromolecular reaction.

Specific examples of methods by which the resin can be manufactured include the methods described in the P. Dreyfuss and R. P. Quirk, *Encycl. Polym. Sci. Eng.*, 7, 551 (1987), Y. Chujo and T. Yamashita '*Senryo to Yakuhin*' ('*Dyes and Chemicals*'), 30, 232 (1985) and A. Ueda and S. Nagai, '*Kagaku to Kogyo*' ('*Science and Industry*'), 60, 57 (1986) and the documents cited in these references.

Preferably the weight-average molecular weight of the dispersion stabilization resin of this invention is $1\times10^4$ to $6\times10^5$ and, still more preferably, it is $2\times10^4$ to $3\times10^5$. If the weight-average molecular weight is less than $1\times10^4$ the average grain diameter of the resin grains produced by polymerization and granulation becomes large (for example, greater than 0.5 μm) and there is a broad grain diameter distribution. Also, if it exceeds $6\times10^5$, the average grain diameter of the resin grains produced by polymerization and granulation is large and it is difficult to achieve an average grain size into the preferred range within 0.15 to 0.4 μm.

Specific processes for manufacturing the dispersion stabilization resin that is used in this invention include (1) processes in which mixtures of monomers corresponding to the repeating units represented by general formula (I), polyfunctional monomers such as those noted earlier and chain transfer agents containing the above-noted acidic groups are polymerized using polymerization initiators (e.g., azobis compounds or peroxides), (2) processes in which the above-noted chain transfer agents are not used but polymerization is effected using polymerization initiators which contain the acidic groups (3) processes using compounds in which the acidic groups are present both in the chain transfer agents and in the polymerization initiators and (4) processes in which a polymerization reaction using compounds containing amino groups, halogen atoms, epoxy groups or acid halide groups, etc. as chain transfer agent or polymerization initiator substituents is effected in the three processes noted above and this is followed by a macromolecular reaction in which the acidic groups are introduced through reaction with the functional groups of the materials.

Examples of suitable chain transfer agents include mercapto compounds containing the acidic groups or substituents from which the acidic groups can be derived (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-(N-(2-mercaptoethyl)carbamoyl)propionic acid, 3-(N-(2-mercaptoethyl)amino)propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethyl amine, 2-mercaptoimidazole, 2-mercapto-3-pyridinol) and iodinated alkyl compounds containing the above-noted acidic groups or substituents (e.g., iodoacetic acid, iodopropionic acid, 2-iodoethanol, 2-iodoethanesulfonic acid, 3-iodopropanesulfonic acid). Mercapto compounds are preferred compounds.

The amounts of such chain transfer agents and polymerization initiators are 0.1 to 15 wt % and preferably 0.5 to 10 wt % relative to 100 parts by weight of the total monomers in each case.

While not desiring to be bound, it is surmized that affinity to the nonaqueous solvent is markedly improved because the dispersion stabilization resin of the invention manufactured in the manner described above interacts with the insoluble resin grains due to its acidic group bonded to only one main polymer chain end and because the component that is soluble in the nonaqueous solvent is crosslinked. Further, it is thought that it is for these reasons that aggregation and precipitation of the insoluble grains are inhibited and their redispersibility is greatly improved.

The monomers used in the production of the nonaqueous dispersion resin can be a monofunctional monomer (A) which is soluble in the nonaqueous solvent but is rendered insoluble by polymerization and a monomer (B) which has at least two polar groups and/or polar linkage groups represented by the above-noted general formula (II) and is copolymerizable with monomer (A).

Monomer (A) used in this invention may be any monomer as long as it is a monofunctional monomer which is soluble in the nonaqueous solvent but is rendered insoluble by polymerization.

Specifically, monomers represented by general formula (III) may be cited as examples.

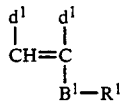

(III)

In general formula (III), $B^1$ represents —COO—, —OCO—, —$CH_2$OCO—, —$CH_2$COO—, —O—,

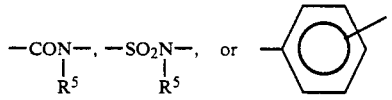

$R^2$ here represents a hydrogen atom or an optionally, substituted aliphatic group having 1 to 18 carbon atoms (e.g., methyl, ethyl, propyl, butyl, 2-chloroethyl, 2-bromoethyl, 2-cyanoethyl, 2-hydroxyethyl, benzyl, chlorobenzyl, methylbenzyl, methoxybenzylo, phenethyl, 3-phenylpropyl, dimethylbenzyl, fluorobenzyl, 2-methoxyethyl, 3-methoxypropyl).

$R_1$ represent a hydrogen atom or an optionally substituted aliphatic group having 1 to 6 carbon atoms (e.g., methyl, ethyl, propyl, butyl, 2-chlorethyl, 2,2-dichloroethyl, 2,2,2-trifluoroethyl, 2-bromoethyl, 2-glycidylethyl, 2-hydroxyethyl, 2-hydroxypropyl, 2,3-dihydroxypropyl, 2-hydroxy--3-chloropropyl, 2-cyanoethyl, 3-cyanopropyl, 2-nitroethyl, 2-methoxyethyl, 2-methanesulfonylethyl, 2-ethoxyethyl , N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, dichlorohexyl).

$d^1$ and $d^2$ may be the same or different and have the same meaning as $a^1$ and $a^2$ in the above-noted general formula (I).

Specific examples of monofunctional monomer (A) include vinyl esters or allyl esters of aliphatic carboxylic acids having 1 to 6 carbon atoms (acetic acid, propionic acid, butyric acid, monochloroacetic acid, trifluoropropionic acid, etc.), optionally substituted alkyl esters or amides having 1 to 4 carbon atoms of acrylic, methacrylic, crononic, itaconic, maleic or similar unsaturated carboxylic acids (examples of alkyl groups being, e.g., methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4carboxybutyl, 3-sulfopropyl, 4-sulfobutyl, 3-chloropropyl, 2 hydroxy-3-chloropropyl, 2-furfurylethyl, 2-pyridinylethyl, 2-thienylethyl, trimethoxysilylpropyl and 2-carboxyamidoethyl), styrene derivatives (e.g., styrene, vinyl toluene, o-methylstyrene, vinyl naphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, N,N-dimethylaminomethylstyrene, vinylbenzenecarboxamide, vinylbenzenesulfonamide), acrylic, methacrylic, crotonic, maleic, itaconic or similar unsaturated carboxylic acids or cyclic anhydrides of maleic or itaconic acid, acrylonitrile, methacrylonitrile and polymerizable double bond containing heterocyclic compounds (specific examples of which include the compounds described in *High Polymer-Basics*, edited by the Kobunshi Gakkai (High Polymer Institute), p. 175–184 published 1986 by Baifukan, e.g., N-vinylpyridine, N-vinyltetrahydrofuran, vinyloxazoline, vinylthiazole, N-vinylmorpholine).

Two or more monomers (A) may be used in combination.

Monomer (B) represented by general formula (II) that is employed in this invention is now described in further detail.

V in general formula (II) is preferably —O—, —COO—, —OCO—, —$CH_2$OCO—, —CONH— or $$-\overset{\overset{W}{|}}{C}ON-,$$

where W is preferably an alkyl group which has a total of 1–16 carbon atoms and which may be substituted, an alkenyl group which has a total of 2–16 carbon atoms and which may be substituted, or an alicyclic group which has a total of 5–18 carbon atoms and which may be substituted or has the same content as the linkage group in general formula (II):

$$\left(U_1-X_1\right)_m\left(U_2-X_2\right)_n Q.$$

Q is preferably a hydrogen atom, a halogen atom (e.g., chloro or bromo atom), or an aliphatic group with a total of 1 to 16 carbon atoms that is optionally substituted by —OH, —CH or —COOH (the aliphatic group being, e.g., an alkyl, alkenyl or aralkyl group).

$X_1$ and $X_2$ may be the same or different and each is preferably —O—, —S—, —CO—, —COO—, —OCO—, $$-\overset{\overset{Q_2}{|}}{C}ON- \quad \text{or} \quad -\overset{\overset{Q_3}{|}}{N}CO-$$

(where $Q_2$ and $Q_3$ have the same meaning as Q noted earlier).

$U_1$ and $U_2$ may be the same or different and are preferably a hydrocarbon group having 1 to 12 carbon atoms which may be substituted or have $$-\underset{\underset{X_3\left(U_4-X_4\right)_p Q_6}{|}}{CH}-$$

inserted in a main chain bond (with alkylene, alkenylene, arylene and cycloalkylene groups being the hydrocarbon groups). $X_3$ and $X_4$ may be the same or different and have the same meaning as $X_1$ and $X_2$ noted above, $U_4$ is preferably an alkylene, alkenylene or arylene group having 1 to 12 carbon atoms, which may be substituted, and $Q_6$ has the same meaning as Q noted above).

$b^1$ and $b^2$ may be the same or different and are preferably hydrogen atoms, methyl groups, —COO—L— or —$CH_2$COO—L— (L preferably being a hydrogen atom or an alkyl, alkenyl, aralkyl or cycloalkyl group having 1 to 18 carbon atoms).

m, n and p may be the same or different and preferably represent 0, 1, 2 or 3.

Still more preferably, V in formula (II) is —COO—, —CONH—, or $$-\overset{\overset{W}{|}}{C}ON-,$$

$b^1$ and $b^2$ may be the same or different and are hydrogen atoms, methyl groups, —COO—L or —$CH_2$COO—L (where L is still more preferably an alkyl group having 1 to 12 carbon atoms).

To give specific examples of $U_1$ and $U_2$, are any combinations of atom groups such as $$-\overset{R^3}{\underset{R^4}{C}}-,$$

(where $R^3$ and $R^4$ represent a hydrogen atoms, alkyl groups or halogen atoms, etc.), (—CH=CH—),

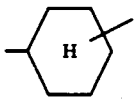

or, $-\underset{X_3-(U_4-X_4)_p-Q_6}{\underset{|}{CH}}-$ (where $X_3$, $X_4$, $Q_6$, $U_4$ and p have the same meanings as the symbols noted earlier).

In the linkage group $$\overset{|}{V}-(U_1-X_1)_m-(U_2-X_2)_n-Q$$

in general formula (II), preferably the linkage main chain from V to Q (i.e., V, $U_1$, $X_1$, $U_2$, $X_2$ and Q) is a portion with a total number of 8 or more atoms. When V here is $$-\overset{W}{\underset{|}{CON}}- \quad \text{or} \quad -SO_2\overset{W}{\underset{|}{N}}-$$

and W is $-(U_1-X_1)_m-(U_2-X_2)_n-Q$, the linkage main chain formed by W is included in the above-noted linkage main chain too. Further, $-X_3-(U_4-X_4)_n-Q_6$ too is included in the linkage main when $U_1$ and $U_2$ are hydrocarbon groups in which $$-\underset{X_3-(U_4-X_4)_p-Q_6}{\underset{|}{CH}}-$$

is inserted in a main chain bond. If, for example, V is —COO— or —CONH—, the hydrogen atom and the oxo group (= O group) atom count is not included in the linkage main chain's atom count but carbon atoms, ether-type oxygen atoms and nitrogen atoms forming the linkage main chain are included in the atom count. Thus, —CO)— or —CONH— counts as 2 atoms. Similarly, if Q represents $-C_9H_{19}$, the hydrogen atoms are not included in the atOm COunt but the Carbon atoms are. In this case, therefore, the atom count is 9.

Specific examples of the monomer (B) are the following compounds.

$$CH_2=\overset{CH_3}{\underset{|}{C}}-COO(CH_2)_2OCOC_9H_{19} \quad \text{(II-1)}$$

$$CH_2=\overset{CH_3}{\underset{|}{C}}-COO(CH_2)_2OCOC_{11}H_{23} \quad \text{(II-2)}$$

$$CH_2=\overset{CH_3}{\underset{|}{C}}-COO(CH_2)_2OCO(CH_2)_5OCOCH_3 \quad \text{(II-3)}$$

-continued $$CH_2=\overset{CH_3}{\underset{|}{C}}-COO(CH_2)_{10}OCOC_6H_{13} \quad \text{(II-4)}$$

$$CH_2=\overset{CH_3}{\underset{|}{C}}-COO(CH_2)_{10}COOC_8H_{17} \quad \text{(II-5)}$$

$$CH_2=\overset{CH_2COOCH_3}{\underset{|}{C}}-COO(CH_2)_3COOC_4H_9 \quad \text{(II-6)}$$

$$CH_2=\overset{CH_3}{\underset{|}{C}}-CONH(CH_2)_6COOC_8H_{17} \quad \text{(II-7)}$$

$$CH_2=\overset{CH_3}{\underset{|}{C}}-COO(CH_2)_2NHCO(CH_2)_3COOCH_3 \quad \text{(II-8)}$$

$$CH_2=\overset{H}{\underset{|}{C}}-COO(CH_2)_3OCOCH=CH-COOC_6H_{13} \quad \text{(II-9)}$$

$$CH_2=\overset{CH_3}{\underset{|}{C}}-COOCH_2\underset{OCOC_5H_{11}}{\underset{|}{CH}}CH_2OCOC_5H_{11} \quad \text{(II-10)}$$

$$CH_2=\overset{CH_3}{\underset{|}{C}}-COOCH_2\underset{OCOC_3H_7}{\underset{|}{CH}}CH_2OCOC_6H_{13} \quad \text{(II-11)}$$

$$CH_2=\overset{CH_3}{\underset{|}{C}}-CON(CH_2CH_2OCOC_5H_{11})_2 \quad \text{(II-12)}$$

$$CH_2=\overset{CH_3}{\underset{|}{C}}-CONH\overset{CH_3}{\underset{CH_3}{\underset{|}{C}}}CH_2SO_2N(C_4H_9)_2 \quad \text{(II-13)}$$

$$\overset{CH_3}{\underset{|}{CH}}=CH-COO(CH_2)_{10}OCOC_6H_{13} \quad \text{(II-14)}$$

$$CH_2=\overset{CH_3}{\underset{|}{C}}-CONH\overset{CH_3}{\underset{CH_2OCOC_4H_9}{\underset{|}{C}}}CH_2OCOC_4H_9 \quad \text{(II-15)}$$

$$CH_2=\overset{H}{\underset{|}{C}}-COO(CH_2)_2OCO(CH_2)_3COOCH_2CH_2Cl \quad \text{(II-16)}$$

-continued (II-17)

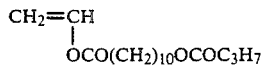

(II-18)

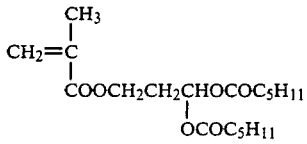

(II-19)

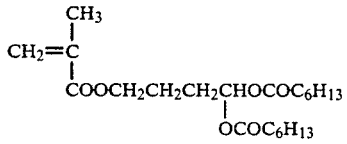

(II-20)

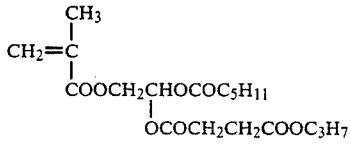

(II-21)

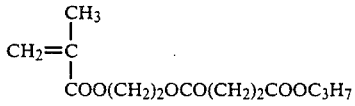

(II-22)

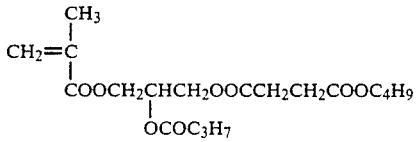

(II-23)

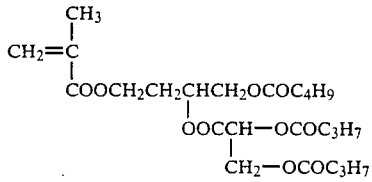

(II-24)

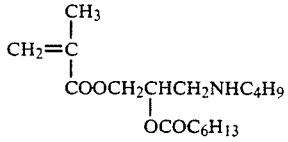

(II-25)

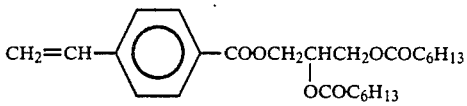

(II-26)

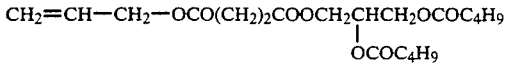

(II-27)

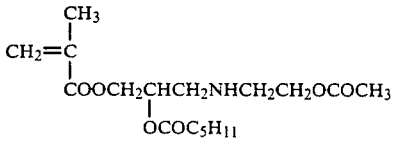

(II-28)

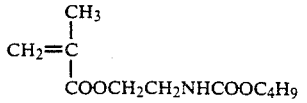

-continued (II-29)

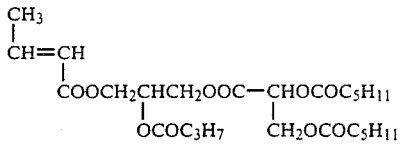

The dispersion resin of this invention comprises of at least one monomer (A) and at least one monomer (B), and an important point is that a required dispersion resin can be produced as long as the resin synthesized from these monomers is insoluble in the nonaqueous solvent. More specifically, the amount of monomer (B) represented by general formula (II) used relative to the insolubilized monomer (A) is preferably 0.1 to 30 wt% and even more preferably it is 0.2 to 10 wt %. The molecular weight of the dispersion resin of the invention is preferably $10^3$ to $10^6$ and even more preferably $10^4$ to $10^6$.

To produce this dispersion resin that is used in this invention, normally it is simply necessary to effect heating and polymerization of monomer (A), monomer (B) and a dispersion stabilization resin as noted above in the nonaqueous solvent in the presence of a polymerization initiator, such as benzoyl peroxide, azobisisobutyronitrile or butyllithium, etc.

Specifically, a method in which a polymerization initiator is added to a mixed solution of the dispersion stabilization resin, monomer (A) and monomer (B), a method in which the procedure is to add monomer (A) and monomer (B) dropwise together with a polymerization initiator to a solution in which the dispersion stabilization resin has been dissolved, a method in which a mixed solution containing a portion of a mixture of monomer (A), monomer (B) and the totality of the dispersion stabilization resin is added in any required manner to a polymerization initiator and the remaining monomer mixture, and a method in which a mixed solution of the dispersion stabilization resin and the monomers is added together with a polymerization initiator in any required manner to the nonaqueous solution, and can be used.

The total amount of monomer (A) and monomer (B) relative to 100 parts by weight of the nonaqueous solvent is 3 to 80 parts by weight and preferably 5 to 50 parts by weight.

The amount of the soluble resin forming the dispersion stabilizer relative to 100 parts by weight of the total monomers used in the above is 1 to 100 parts by weight and preferably 5 to 50 parts by weight.

The amount of polymerization initiator is suitably 0.1 to 5% (by weight) of the total monomer quantity The polymerization temperature is around 50° to 180° C. The reaction time is preferably 1 to 15 hours.

Where joint use is made of polar solvents such as the above-noted alcohols, ketones, ethers or esters, etc., in the nonaqueous solvent employed in the reaction or where unreacted portions of the polymerized and granulated monomer (A) or monomer (B) remain, it is preferable to remove them by distilling them off by heating to above the boiling points of the solvents or monomers or by distilling them off under reduced pressure.

The nonaqueous latex grains prepared in the manner described above are fine and have a uniform grain size distribution and they also display very stable dispersibility. In particular, their dispersibility is good even in long-term, repeated use in a development apparatus and they are easily redispersed and no fouling at all through adhesion to various parts of the apparatus is observed even when the development speed is increased.

Further, when fixing is effected by heating, etc., excellent fixing characteristics are displayed and strong films are formed.

In addition, the dispersion stability, redispersibility and fixing characteristics of the liquid developing agent of this invention are excellent even when the development - fixing stages are conducted rapidly and large-size master plates are used.

Coloring agents may be used in the liquid developer of the invention if desired.

There are no particular restrictions with regard to the coloring agents and various types of conventionally known pigments and dyes may be used.

One example of a method of coloration for coloring the actual dispersion resin itself is to physically disperse a pigment or dye in the dispersion resin. Very many pigments and dyes that can be used for this are known, examples one may cite including magnetic iron oxide powders, powdered lead iodide, carbon black, nigrosine, alkali blue, hansa yellow, quinacridone red and phthalocyanine blue.

Another coloration method is to dye the dispersion resin with a suitable dye as disclosed in, e.g., JP-A-57-48738. Other methods include a method in which the dispersion resin and a dye are chemically bonded as disclosed in JP-A-53-54029 and the method in which, as disclosed in JP-B-44-22955 (the term "JP-B" as used herein means an "examined Japanese patent publication"), in manufacture by polymerization and granulation, a copolymer containing a coloring material is produced by using a monomer into which the coloring material has been introduced beforehand.

The liquid developer of the invention may contains a variety of additives, if redesired, for the purpose of reinforcing its charge characteristics or improving the image characteristics, etc. For example, one may use the additives specifically described by Y. Harasaki, '*Denshi Shashin*') ('*Electronic Photography*'), Vol. 16, No. 2, page 44.

Specific examples include, for example, di-2-ethylhexylsulfosuccinic acid metal salts, naphthenic acid metal salts, higher fatty acid metal salts, lecithin, poly(-vinylpyrrolidone) and copolymers containing hemimaleamide components.

The amounts of the various principal components of the liquid developing agent of the invention, are described below.

The amount of the toner grains whose main component is resin (together with a coloring agent which is used if required) is preferably 0.5 to 50 parts by weight per 1000 parts by weight of carrier liquid. If it is less than 0.5 parts by weight, there is insufficient image density, while if it exceeds 50 parts by weight, fogging tends to occur in the non-image portions. One may also use, as required, the above-noted resin for dispersion stabilization that is soluble in the carrier liquid and this may be added in an amount on the order of 0.5 to 100 parts by weight per 1000 parts by weight of the carrier liquid. The amount of a charge regulator, as mentioned above, is preferably 0.001 to 1.0 parts by weight per 1000 parts by weight of the carrier liquid. Also, various additives may be present if required. The upper limit of the total amount of these additives is restricted only by electrical resistance of the liquid development agent. It is necessary to control the amounts of the various additives present so that the total comes within this limit, since if the electrical resistance of the liquid developer, without the toner grains present, is lower than $10^9$ Ω cm, it is difficult to produce good quality continuous tone images.

Examples of the synthesis of resins used in these invention and examples of this invention are given below. Unless otherwise indicated, all parts, percents, ratios and the are by weight.

SYNTHESIS EXAMPLE 1

Dispersion Stabilization Resin

Production of Dispersion Stabilization Resin P-1

A mixed solution of 97 g of octadecyl methacrylate, 3 g of thioglycolic acid, 5.0 g of divinylbenzene and 200 g of toluene was heated to 85° C. in a nitrogen gas stream while being stirred. 0.8 g of 1,1 ∝-azobis(cyclohexane-1-carbonitrile) (abbreviated "A.C.H.N.") was added and reacted for 4 hours, then 0.4 g of A.C.H.N. was added and reacted for 2 hours and then 0.2 g of A.C.H.N. was added and reacted for 2 hours. After cooling, the mixed solution was reprecipitated in 1.5 liters of methanol, a white powder was collected by filtration and then dried, giving 88 g of powder. The weight-average molecular weight of the resulting polymer was 30,000.

SYNTHESIS EXAMPLE 2–9

Dispersion Stabilization Resin

Production of Dispersion Stabilizaiton Resins P-2 - P-9

Various dispersion stabilization resins were manufactured in the same way as in Synthesis Examples 1 except that the monomers listed in Table 1 below were employed instead of the octadecylmethacrylate used in Synthesis Example 1.

TABLE 1

| Synthesis Example | Dispersion Stabilization Resin | Monomer | | Weight Average Molecular Weight |
|---|---|---|---|---|
| 2 | P-2 | Dodecyl methacrylate | 97 g | 32,000 |
| 3 | P-3 | Tridecyl methacrylate | 97 g | 31,000 |
| 4 | P-4 | Octyl methacrylate | 17 g | 29,000 |
| | | Dodecyl methacrylate | 80 g | |
| 5 | P-5 | Octadecyl methacrylate | 70 g | 33,000 |
| | | Butyl methacrylate | 27 g | |
| 6 | P-6 | Dodecyl methacrylate | 92 g | 34,000 |
| | | N,N-Dimethyl-aminoethyl methacrylate | 5 g | |
| 7 | P-7 | Octadecyl methacrylate | 93 g | 29,000 |
| | | 2-(Trimethoxy-silyloxy)ethyl methacrylate | 4 g | |
| 8 | P-8 | Hexadecyl methacrylate | 97 g | 31,000 |
| 9 | P-9 | Tetradecyl methacrylate | 97 g | 32,000 |

SYNTHESIS EXAMPLES 10–22

Dispersion Stabilization Resin

Production of Dispersion Stabilization Resins P-10 - P-22

Various dispersion stabilization resin were prepared following the same procedure as in Synthesis Example 1 except that instead of the 5 g of divinylbenzene as the polyfunctional monomer for crosslinking in Synthesis Example 1, the polyfunctional monomers or oligomers listed in Table 2 below were used.

TABLE 2

| Synthesis Example | Dispersion Stabilization Resin | Crosslinking Monomer or Oligomer | Amount Used | Weight Average Molecular Weight |
|---|---|---|---|---|
| 10 | P-10 | Ethylene glycol dimethacrylate | 4 g | 35,000 |
| 11 | P-11 | Diethylene glycol dimethacrylate | 4.5 g | 29,000 |
| 12 | P-12 | Vinyl methacrylate | 6 g | 40,000 |
| 13 | P-13 | Isopropenyl methacrylate | 6 g | 33,000 |
| 14 | P-14 | Divinyl adipate | 8 g | 32,000 |
| 15 | P-15 | Diallyl glutaconate | 10 g | 30,000 |
| 16 | P-16 | ISP-22GA made by the Okamura Seiyu (KK) | 10 g | 45,000 |
| 17 | P-17 | Triethylene glycol diacrylate | 2 g | 50,000 |
| 18 | P-18 | Trivinylbenzene | 2 g | 55,000 |
| 19 | P-19 | Polyethylene glycol #400 diacrylate | 5 g | 38,000 |
| 20 | P-20 | Polyethylene glycol dimethacrylate | 6 g | 40,000 |
| 21 | P-21 | Trimethylol-propane triacrylate | 1.8 g | 56,000 |
| 22 | P-22 | Polyethylene glycol #600 diacrylate | 6 g | 35,000 |

SYNTHESIS EXAMPLE 23

Dispersion Stabilization Resin

Production of Dispersion Stabilization Resin P-23

A mixed solution of 97 g of octadecyl methacrylate, 3 g of thiomalic acid, 4.5 g of divinyl benzene, 150 g of toluene and 50 g of ethanol was heated to 60° C in a nitrogen gas stream. 0.5 g of 2,2'-azobis(isobutyronitrile) (abbreviated "A.I.B.N.") was added and reacted for 5 hours, then 0.3 g of A.I.B.N. was added and reacted for 3 hours and then 0.2 g of A.I.B.N. was added and reacted for 3 hours. After cooling, the material was reprecipitated in 2 liters of methanol and a white powder was collected by filtration and then dried. The yield was 85 g and the weight-average molecular weight of the polymer was 35,000.

SYNTHESIS EXAMPLE 24–29

Dispersion Stabilization Resin

Production of Dispersion Stabilization P-24 - P-29

Dispersion stabilization resins were produced following the same procedure as in Synthesis Examples 23 except that the mercapto compounds shown in Table 3 below were employed instead of the 3 g of thiomalic acid that was used in Synthesis Example 23.

TABLE 3

| Synthesis Example | Dispersion Stabilization Resin | Mercapto Compound | Weight Average Molecular Weight |
|---|---|---|---|
| 24 | P-24 | $HSCH_2CH_2COOH$ | 36,000 |
| 25 | P-25 | 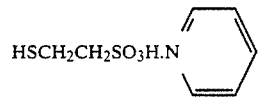 | 29,000 |
| 26 | P-26 | 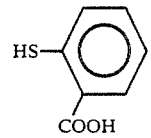 | 38,000 |
| 27 | P-27 | 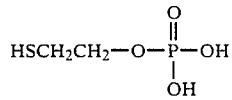 | 33,000 |
| 28 | P-28 | $HSCH_2CH_2NHCO(CH_2)_2COOH$ | 37,000 |
| 29 | P-29 | $HSCH_2CH_2NHCH_2CH_2COOH$ | 35,000 |

SYNTHESIS EXAMPLE 30

Dispersion Stabilization Resin

Production of Dispersion Stabilization Resin P-30

A mixture of 94 g of hexadecyl methacrylate, 1.0 g of diethylene glycol dimethacrylate, 150 g of toluene and 50 g of isopropyl alcohol was heated to 90° C. in a nitrogen gas stream. 6 g of 2,2'-azobis(4-cyanovaleric acid) (abbreviated "A.C.V.") was added and reacted for 8 hours. After cooling, the reaction solution was reprecipitated in 1.5 liters of methanol and a white powder was collected by filtration and then dried. The yield was 83 g and the weight-average molecular weight of the polymer was 65,000.

SYNTHESIS EXAMPLE 31

Dispersion Stabilization Resin

Production of Dispersion Stabilization Resin P-31

A mixed solution of 92 g of docosanyl methacrylate, 1.5 g of ISP-22GA (manufactured by Okamura Seiyu K.K.), 150 g of toluene and 50 g of ethanol was heated to 80° C. in a nitrogen gas stream. 8 g of 4,4'-azobis(-4cyanopentanol) was added and reacted for 8 hours. After cooling, the reaction solution was reprecipitated in 1.5 liters of methanol and a white powder was collected by filtration and then dried. The yield was 78 g and the weight-average molecular weight of the polymer was 41,000.

SYNTHESIS EXAMPLE 32

Dispersion Stabilization Resin

Production of Dispersion Stabilization Resin P-32

A mixed solution of 95 g of octadecyl methacrylate, 5 g of 2-mercaptoethylamine, 5 g of divinylbenzene and 200 g of toluene was heated to 85° C. in a nitrogen gas stream. 0.7 g of A.C.H.N. was added and reacted for 8 hours.

Next, 8 g of glutaconic anhydride and 1 ml of concentrated sulfuric acid were added and reacted at a temperature of 100° C. for 6 hours. After cooling, the material was reprecipitated in 1.5 liters of methanol and a white power was collected by filtration and then dried. The yield was 83 g and the weight-average molecular weight of the polymer was 31,000.

SYNTHESIS EXAMPLE 33

Dispersion Stabilization Resin

Production of Dispersion Stabilization Resin P-33

A mixed solution of 95 g of octadecyl methacrylate, 3 g of thioglycolic acid, 6 g of ethylene glycol dimethacrylate, 150 g of toluene and 50 g of ethanol was heated to 80° C. in a nitrogen gas stream. 2 g of A.C.V. was added and reacted for 4 hours and then a further 0.5 g of A.C.V. was added and reacted for 4 hours. After cooling, the material was reprecipitated in 1.5 liters of methanol and a white powder was collected by filtration and then dried. The yield was 80 g and the weight-average molecular weight of the polymer was 35,000.

SYNTHESIS EXAMPLE 34

Dispersion Stabilization Resin

Production of Dispersion Stabilization Resin P-34

A mixed solution of 94 g of tridecyl methacrylate, 6 g of 2-mercaptoethanol, 9 g of divinylbenzene, 150 g of toluene and 50 g of ethanol was heated to 80° C. in a nitrogen gas stream. 4 g of A.C.H.N. was added and reacted for 4 hours and then a further 2 g of A.C.H.N. was added and reacted for 4 hours.

After cooling, the material was reprecipitated in 1.5 liters of methanol and a viscous substance obtained on removal of the methanol by decantation was dried. The yield was 75 g and the weight-average molecular weight of the polymer was 29,000.

SYNTHESIS EXAMPLE 35

Dispersion Stabilization Resin

Production of Dispersion Stabilization Resin P-35

A mixture of 50 g of Dispersion Stabilization Resin P-34, 100 g of toluene, 10 g of succinic anhydride and 0.5 g of pyridine was reacted for 10 hours at a temperature of 90° C. After cooling, the material was reprecipitated in 0.8 liters of methanol and a viscous substance obtained on removal of the methanol by decantation was dried. The yield was 43 g and the weightaverage molecular weight of the polymer was 30,000.

SYNTHESIS EXAMPLE 36–39

Dispersion Stabilization Resin

Production of Dispersion Stabilization Resin P-36 - P-39

Dispersion stabilization resins were manufactured following the same procedure as in Synthesis Example 35 except that the dicarboxylic anhydrides listed in Table 4 below were employed instead of the succinic anhydride that was used in Synthesis Example 35 for the above-described Dispersion Stabilization Resin P-35.

TABLE 4

| Synthesis Example | Dispersion Stabilization Resin | Dicarboxylic Anhydride | Amount Used | Weight Average Molecular Weight |
|---|---|---|---|---|
| 36 | P-36 | Maleic anhydride | 8.5 g | 30,000 |
| 37 | P-37 | Adipic anhydride | 11 g | 30,000 |
| 38 | P-38 | Phthalic anhydride | 10 g | 30,000 |
| 39 | P-39 | Trimellitic anhydride | 12.5 g | 30,000 |

SYNTHESIS EXAMPLE 40

Dispersion Stabilization Resin

Production of Dispersion Stabilization Resin P-40

A mixture of 86 g of octadecyl methacrylate, 10 g of N-methoxymethylacrylamide, 4 g of thioglycolic acid, 150 g of toluene and 50 g of isopropanol was heated to 80° C. in a nitrogen gas stream.

0.8 g of A.C.H.N. was added and reacted for 8 hours. Then, following the Dean-Stark procedure, the material was heated to a temperature of 110° C. and stirred for 6 hours. The isopropanol solvent that had been used and by-product methanol were removed.

After cooling, the material was reprecipitated in 1.5 liters of methanol and a white powder was collected by filtration and then dried. The yield was 82 g and the weight-average molecular weight of the polymer was 45,000.

SYNTHESIS EXAMPLE 41

Latex Grain Production of Latex Grains D-1

A mixed solution of 12 g of Dispersion Stabilization resin P-1, 100 g of vinyl acetate, 1.5 g of monomer (B), Compound II-19, and 384 g of Isopar H was heated to 70° C. while being stirred in a nitrogen gas stream. 0.8 g of 2,2'-azobis(isovaleronitrile) (abbreviation A.I.V.N.) was added and the materials were reacted for 6 hours. 20 minutes after addition of the polymerization initiator, a white cloudiness appeared and the temperature increased to 88° C. The temperature was increased to 100° C., the material was stirred for 2 hours and unreacted vinyl acetate was distilled off. After cooling, the material was passed through a 200 mesh nylon cloth, to obtain a white dispersion which was latex with a polymerization degree of 86% and an average grain diameter of 0.20 μm.

SYNTHESIS EXAMPLE42–62

Latex Grain Production of Latex Grains D-2 - D-22

7 Various latex grains were manufactured using the same procedure as in Synthesis Example 41 except that the Dispersion Stabilization Resins and Monomers (B) listed in Table 5 below were employed instead of Dispersion Stabilization Resin P-1 and Monomer (B) Compound II-19 that were used in Synthesis Example 41. the polymerization ratios of the various grains were 85–90%.

TABLE 5

| Latex Synthesis example | Latex Grains | Dispersion Stabilization Resin | Monomer (B) | Latex Average Grain Diameter |
|---|---|---|---|---|
| 42 | D-2 | F-1 | II-1 | 0.19 μm |

TABLE 5-continued

| Latex Synthesis example | Latex Grains | Dispersion Stabilization Resin | Monomer (B) | Latex Average Grain Diameter |
|---|---|---|---|---|
| 43 | D-3 | " | II-2 | 0.19 |
| 44 | D-4 | " | II-3 | 0.20 |
| 45 | D-5 | " | II-8 | 0.22 |
| 46 | D-6 | " | II-9 | 0.22 |
| 47 | D-7 | " | II-10 | 0.20 |
| 48 | D-8 | " | II-11 | 0.18 |
| 49 | D-9 | " | II-14 | 0.17 |
| 50 | D-10 | " | II-18 | 0.21 |
| 51 | D-11 | P-2 | II-10 | 0.19 |
| 52 | D-12 | P-3 | II-29 | 0.20 |
| 53 | D-13 | P-4 | II-20 | 0.22 |
| 54 | D-14 | P-5 | II-21 | 0.22 |
| 55 | D-15 | P-6 | II-22 | 0.23 |
| 56 | D-16 | P-12 | II-23 | 0.23 |
| 57 | D-17 | P 14 | II-24 | 0.22 |
| 58 | D-18 | P-16 | II-15 | 0.23 |
| 59 | D-19 | P-18 | II-16 | 0.18 |
| 60 | D-20 | P-23 | II-26 | 0.19 |
| 61 | D-21 | P-24 | II-27 | 0.20 |
| 62 | D-22 | P-26 | II-29 | 0.21 |

LATEX GRAIN SYNTHESIS EXAMPLE 43

Production of Latex Grains D-23

A mixed solution of 8 g (in terms of the solid fraction) of Resin P-25 produced in Dispersion Stabilization Resin Synthesis Example 25, 7 g of poly(dodecyl methacrylate), 100 g of vinyl acetate, 1.5 g of monomer (B), Compound II-15, and 380 g of n-decane was heated to 75° C. while being stirred in a nitrogen gas stream. 1.0 g of 2,2'-azobis(isobutyronitrile) (abbreviation: A.I.B.N.) was added and reacted for 4 hours and then a further 0.5 g of A.I.B.N. was added and reacted for 2 hours. The temperature was increased 110° C. and the materials were stirred for 2 hours and the low-boiling solvent and residual vinyl acetate were distilled off. After cooling, the material was passed through a 200 mesh nylon cloth, to obtain a white dispersion which was a latex with an average grain diameter of 0.20 μm.

LATEX GRAIN SYNTHESIS EXAMPLE 44

Production of Latex Grains D-24

A mixed solution of 14 g of Resin P-1 produced in Dispersion Stabilization Resin Synthesis Example 1, 85 g of vinyl acetate, 2.0 g of monomer (B) Compound II-23, 15 g of N-vinylpyrrolidone and 400 g of isododecane was heated to 65° C. while being stirred in a nitrogen gas stream. 1.5 g of A.I.B.N. was added and reacted for 4 hours. After cooling, the material was passed through a 200 mesh nylon cloth, to obtain a white dispersion which was a latex with an average grain diameter of 0.26 μm.

LATEX GRAIN SYNTHESIS EXAMPLE 45

Production of Latex Grains D-25

A mixed solution of 12 g of Resin P-5 produced in Dispersion Stabilization Resin Synthesis Example 5, 100 g of vinyl acetate, 1.5 g of monomer (B) Compound II-18, 5 g of 4-pentenic acid and 383 g of Isopar G was heated to 60° C. while being stirred in a nitrogen gas stream. 1.0 g of A.I.V.N. was added and reacted for 2 hours. Then a further 0.5 g of A.I.V.N. was added and reacted for 2 hours. After cooling, the material was passed through a 200 mesh nylon cloth, to obtain a white dispersion which was a latex with an average grain diameter of 0.25 μm.

LATEX GRAIN SYNTHESIS EXAMPLE 46

Production of Latex Grains D-26

A mixed solution of 20 g of Resin P-20 produced in Dispersion Stabilization Resin Synthesis Example 20, 2 g of monomer (B) Compound II-16, 100 g of methyl methacrylate and 478 g of Isopar H was heated to 65° C. while being stirred in a nitrogen gas stream. 1.2 g of A.I.V.N. was added and reacted for 4 hours. After cooling, the material was passed through a 200 mesh nylon cloth to remove coarse grains, and the resulting white dispersion was a latex with an average grain diameter of 0.36 μm.

LATEX GRAIN SYNTHESIS EXAMPLE 47

Production of Latex Grains D-27

A mixed solution of 18 g of Resin P-21 produced in Dispersion Stabilization Resin Synthesis Example 21, 100 g of styrene, 4 g of monomer (B) Compound II-25 and 380 g of Isopar H was heated to 50° C. while being stirred in a nitrogen gas stream. An n-butyllithium hexane solution was added in an amount to give 1.0 g in terms of the solid fraction and the materials were reacted for 4 hours. After cooling, the materials were reacted for 4 hours. After cooling, the material was passed through a 200 mesh nylon cloth, to obtain a white dispersion which was a latex with an average grain diameter of 0.30 μm.

PRODUCTION OF LATEX GRAIN (COMPARISON SYNTHESIS EXAMPLE A)

The procedures carried out were the same as in Latex Grain Synthesis Example 41 except that use was made of a mixed solution of 20 g of poly(octadecyl methacrylate) (weight-average molecular weight 35,000), 100 g of vinyl acetate, 1.5 g of monomer (B) Compound Example II-19 and 380 g of Isopar H and this gave a white dispersion of latex grains with a polymerization degree of 88% and an average grain diameter of 0.23 μm.

PRODUCTION OF LATEX GRAIN (COMPARISON SYNTHESIS EXAMPLE B)

The procedures carried out were the same as in Latex Grain Synthesis Example 41 except that use was made of a mixed solution of 14 g of a dispersion stabilization resin with the structure indicated below, 100 g of vinyl acetate, 1.5 g of monomer (B) Compound II-19 and 386 g of Isopar H and this gave a white dispersion of latex grains with a polymerization degree of 90% and an average grain diameter of 0.25 μm.

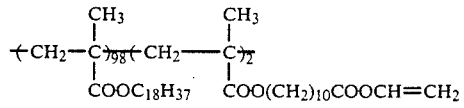

Molecular weight 43,000

EXAMPLE 1 and COMPARISON EXAMPLES A-B 10 g of a dodecyl methacrylate acrylic acid copolymer (copolymerization ratio 95/5 weight ratio), 10 g of nigrosine and 30 g of Shellsol 71 were put into a paint shaker (Tokyo Seiki KK) together with glass beads and dispersed for 4 hours, to give a nigrosine microdispersion.

An electrostatic photographic liquid developer was prepared by diluting 30 g of Resin Dispersion D-1 of Latex Grain Synthesis Example 41, 2.5 of the above nigrosine dispersion, 0.08 g of an octadecene hemimaleicoctadecylamide copolymer and 15 g of FOC-1400 (a higher alcohol manufactured by Nissan Kagaku KK) with 1 liter of Shellsol 71.

COMPARISON EXAMPLE DEVELOPING AGETNS A-B

Two Liquid Developing Agents A and B for comparison were prepared by replacing the Resin Dispersion D-1 used in the production of the above developing agent by the following resin dispersions.

COMPARISON LIQUID DEVELOPING AGENT A

A resin dispersion of Latex Grain Synthesis Example 68.

COMPARISON LIQUID DEVELOPING AGENT B

A resin dispersion of latex Grain Synthesis Example 69.

These various liquid developing agents were used as developing agents for an ELP404V fully automatic developing unit (manufactured by Fuji Photo Film Co., Ltd.) and ELP Master II Type, which is electrophotographic photosensitive material (manufactured by Fuji Photo Film Co., Ltd.), was exposed and developed. The platemaking speed was 5 plates/minute. After the processing of 2000 plates of ELP Master II type, an examination was made to check for fouling through adhesion of toner to the development apparatus. The blackening ratio (image area) of copy images was checked using original documents having 30% of image area. The results are given in Table 6 below.

TABLE 6

| No. | Test | Developer | Development Unit Fouling | Plate Image at 2,000 Copies |
|---|---|---|---|---|
| 1 | This Invention | Example 1 | ○ Absolutely soiling | ○ Clear |
| 2 | Comparative Example A | Developer A | xxx Marked production of toner residue | x Occurrence of lettering defects, scratching in the greased area and base fogging |
| 3 | Comparative Example B | Developer B | x Slight occurrence of toner residue | Δ Deterioration in the Dmax of the greased portions, slight scratching of fine lines |

As is clear from the results shown in Table 6 above, when plates were made using the various developer under the platemaking conditions noted above, it was only with the developer of the invention that there was absence of fouling of the developing apparatus and also that the image of the 2000th plate produced was clear.

Master plates for offset printing (ELP masters) that were produced using the various developing solutions were printed using normal procedures and a comparison was made of the numbers of prints that could be made before dropout of letters or scratches in blocked portions, etc. occurred in the printed images. It was found that with master plates produced using the developing agents of the invention and Comparison Examples A-B no such faults occurred even after more than 10,000 printings.

It can be seen from these results that it was only with a developing agent using resin grains of the invention that there was a complete absence of fouling of the development apparatus and also that the number of master plate printings was good.

That is, with Comparison Examples A and B, there was no problem with the number of printings but fouling of the development apparatus was marked and the developing agents of these examples did not permit continuous use.

These results show that the resin grains of the present invention are clearly superior.

EXAMPLE 2

A mixture of 100 g of the white Dispersion D-2 produced in Latex Grain Synthesis Example 42 and 1.5 g of Sumicaron Black was heated to 100° C. and stirred while heating for 4 hours. Passage of the material through a 200 mesh nylon cloth and removal of the residual dye following cooling to room temperature gave a black resin dispersion with an average grain size of 0.20 μm.

A liquid developing agent was prepared by diluting 32 g of this black resin dispersion and 0.05 g of zirconium naphthenate with 1 liter of Shellsol 71.

When development was effected using an apparatus as in Example 1, fouling of the apparatus through toner adhesion even after development of 2000 copies did not occur at all.

Further, there was clear image quality with the offset printing master plate that was produced and the image quality of printed items was still very clear even after 10,000 printings.

EXAMPLE 3

A mixture of 100 g of the white Resin Dispersion D-25 produced in Latex Grain Synthesis Example 65 and 3 g of victoria blue B was heated to 70°-80° C. and stirred for 6 hours. Passage of the material through a 200 mesh nylon cloth and removal of the residual dye following cooling to room temperature gave a blue resin dispersion with an average grain size of 0.26 μm.

A liquid developing agent was prepared by diluting 32 g of this blue resin dispersion and 0.05 g of zirconium naphthenate with 1 liter of Isopar H.

When development was effected using an apparatus as in Example 1, no fouling at all of the apparatus by adhering toner was observed even after development of 2,000 copies. Further, there was clear image quality with the offset printing master plate that was produced and the images of printed items were still very clear even after 10,000 printings.

EXAMPLE 4

A liquid developing agent was prepared by using 1 liter of Isopar G to dilute 32 g of the white Resin Dispersion D-2 produced in Latex Grain Synthesis Example 42, 2.5 g of the nigrosine dispersion produced in Example 1 and 0.02 g of an octadecyl vinyl ether and maleic anhydride copolymer hemidocosanylamide compound.

When development was effected using an apparatus as in Example 1, no fouling at all of the apparatus by adhering toner was observed even after development of 2,000 copies. Further, there was clear image quality with the offset printing master plate that was produced and the images of printed items were still very clear even after 10,000 printings.

Further, when the same processing was effected after the developing agent had been left for 3 months, no changes with elapse of time at all were observed.

EXAMPLE 5

An alkali blue microdispersion was produced by putting 10 g of poly(decyl methacrylate), 30 g of Isopar H and 8 g of alkali blue into a paint shaker together with glass beads and effecting dispersion for 2 hours.

A liquid developing agent was prepared by using 1 liter of Isopar G to dilute 30 g of the white Resin Dispersion D-10 produced in Latex Grain Synthesis Example 50, 4.2 g of the above alkali blue dispersion and 0.06 g of a diisobutylene maleic anhydride copolymer hemidocosanylamide compound.

When development was effected using an apparatus as in Example 1, no fouling at all of the apparatus by adhering toner was observed even after development of 2,000 copies. Further, there was very clear image quality with the offset printing master plate that was produced and the images of printed items were still very clear even after 10,000 printings.

EXAMPLE 6–22

Liquid developing agent were following the same procedure as in Example 5 except that instead of the latex grain white Resin Dispersion D-10 that was employed in Example 5, in the latex grains listed in Table 7 below amounts corresponding to 6.0 g in terms of solid fraction were used.

TABLE 7

| Example | Latex Grains | Fouling of Developing Unit | Plate Image at 2,000 Copies |
|---|---|---|---|
| 6 | D-3 | ○ No occurrence of toner sediment | ○ Clear |
| 7 | D-4 | ○ No occurrence of toner sediment | ○ Clear |
| 8 | D-5 | ○ No occurrence of toner sediment | ○ Clear |
| 9 | D-6 | ○ No occurrence of toner sediment | ○ Clear |
| 10 | D-7 | ○ No occurrence of toner sediment | ○ Clear |
| 11 | D-9 | ○ No occurrence of toner sediment | ○ Clear |
| 12 | D-11 | ○ No occurrence of toner sediment | ○ Clear |
| 13 | D-12 | ○ No occurrence of toner sediment | ○ Clear |
| 14 | D-13 | ○ No occurrence of toner sediment | ○ Clear |
| 15 | D-14 | ○ No occurrence of toner sediment | ○ Clear |
| 16 | D-15 | ○ No occurrence of toner sediment | ○ Clear |
| 17 | D-16 | ○ No occurrence of toner sediment | ○ Clear |
| 18 | D-17 | ○ No occurrence of toner sediment | ○ Clear |
| 19 | D-18 | ○ No occurrence of toner sediment | ○ Clear |
| 20 | D-19 | ○ No occurrence of toner sediment | ○ Clear |
| 21 | D-20 | ○ No occurrence of toner sediment | ○ Clear |
| 22 | D-22 | ○ No occurrence of toner sediment | ○ Clear |

When development was effected using an apparatus as in Examples 1, no fouling at all of the apparatus by adhering toner was observed even after development of 2000 copies. Further, there was very clear image quality with the offset printing master plates that were produced and the images of printed items were still very clear even after 10,000 printings.

This invention provides developing solutions with excellent dispersion stability, re-dispersibility and fixing characteristics. In particular, there is no fouling of the development apparatus even in platemaking conditions in which plates are made at a very rapid speed and the images of the offset master printing plates that are produced and also the images of printed items after 10,000 printings are of very clear quality.

While the invention has been described in detail and with reference to specific examples thereof, it will be apparent to one skilled in the art that various changes and modifications can be made therein without departing from the spirit and scope thereof.

What is claimed is:

1. A liquid developer for electrostatic photography comprising at least one resin dispersed in a nonaqueous solvent with an electrical resistance of $10^9$ Ω cm or more and a dielectric constant of 3.5 or less, wherein said dispersed resin grains comprise copolymer resin grains produced by polymerization of a solution containing at least one monofunctional monomer (A) which is soluble in said nonaqueous solvent but is rendered insoluble by polymerization and at least one monomer (B) which contains at least two polar groups and/or polar linkage groups and is represented by the general formula (II) below

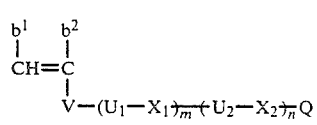

(II)

wherein, V represents —O—, —COO—, —OCO—, —$CH_2OCO$—, —$SO_2$—, —CONH—, —$SO_2NH$—, $$-\overset{W}{\overset{|}{C}}ON-,\quad -\overset{W}{\overset{|}{N}}SO_2-,$$

where W represents a hydrocarbon group or has the same meaning as the linkage group:

$$\left(U_1-X_1\right)_m\left(U_2-X_2\right)_n Q$$

in general formula (II)

Q represents a hydrogen atom, or a hydrocarbon group having 1 to 18 carbon atoms which may be substituted by a halogen atom, —OH, —CN, —$NH_2$, —COOH, —$SO_3H$ or —$PO_3H_2$;

$X_1$ and $X_2$, which may be the same or different, each represents —O—, —S—, —CO—, —$CO_2$—, —OCO—, —$SO_2$—, $$-\overset{Q_1}{\overset{|}{N}}-,\ -\overset{Q_2}{\overset{|}{N}}CO-,\ -\overset{Q_3}{\overset{|}{N}}CO-,\ -\overset{Q_4}{\overset{|}{N}}SO_2-,\ -\overset{Q_5}{\overset{|}{N}}SO_2-,$$

—$NHCO_2$— or —NHCONH— where $Q_1$, $Q_2$, $Q_3$, $Q_4$ and $Q_5$ have the same meaning as Q above;

$U_1$ and $U_2$, which may be the same or different, each represents a hydrocarbon group having 1 to 18 carbon atoms which may be substituted or have $$-\underset{X_3\left(U_4-X_4\right)_p Q_6}{\underset{|}{CH}}-$$

inserted in a main chain bond where $X_3$ and $X_4$ which may be the same or different has the same measuing as $X_1$ and $X_2$ above, $U_4$ represents a hydrocarbon group having 1 to 18 carbon atoms which may be substituted and $Q_6$ has the same meaning as Q above;

$b^1$ and $b^2$, which may be the same or different, each represents a hydrogen atom, a hydrocarbon group, —COO—L or —COO—L— linked via a hydrocarbon where L represents a hydrogen atom or a hydrocarbon group which may be substituted; and m, n and p, which may be the same or different, each represents an integer of 0 to 4;

in the presence of a resin for dispersion stabilization which is soluble in said nonaqueous solvent and is a polymer which has repeating units represented by the general formula (I) below $$\left(\overset{a^1}{\overset{|}{C}}-\underset{H}{\underset{|}{\overset{a^2}{\overset{|}{C}}}}\underset{T^1-Y^1}{\underset{|}{}}\right) \qquad (I)$$

wherein $T^1$ represents —COO—, —OCO—, —$CH_2OCO$—, —$CH_2COO$—, —O— or —$SO_2$—, $Y^1$ represents an aliphatic group having 6 to 32 carbon atoms;

$a^1$ and $a^2$, which may be the same or different, each represents a hydrogen atom, a halogen atom, a cyano group, a hydrocarbon group having 1 to 8 carbon atoms, —COO—$Z^1$ or —COO—$Z^1$ linked via a hydrocarbon group having 1 to 8 carbon atoms where $Z^1$ represents a hydrocarbon group having 1 to 22 carbon atoms, a portion of which is crosslinked and in which an acidic group selected from the group consisting of —$PO_3H_2$, —$SO_3H$, —COOH, —OH, —SH and $$-\overset{O}{\overset{\|}{\underset{OH}{\underset{|}{P}}}}-OR^{\circ}$$

groups, where R° represents a hydrocarbon group, is bonded to only one end of at least one polymer main chain.

2. The liquid developing agent for electrophotography according to claim 1, wherein the non-aqueous solvent as a carrier liquid is a linear chain or branched chain aliphatic hydrocarbon, an alicyclic hydrocarbon, an aromatic hydrocarbon, a halogen derivative thereof or a mixture thereof.

3. The liquid developing agent for electrophotography according to claim 1, wherein $T^1$ is —COO—, —OCO—, —$CH_2OCO$—, —$CH_2COO$— or —O—, $Y^1$ is an aralkyl group, an alkenyl group or an alkyl group, each having from 8 to 22 carbon atoms.

4. The liquid developing agent for electrophotography according to claim 1, wherein the amount of the repeating unit of the monomer (B) to the repeating unit of monomer (A) is 0.1 to 30 wt %.

5. The liquid developing agent for electrophotography according to claim 1, wherein the weight average molecular weight of the resin for dispersion stabilization is from $1\times10^4$ to $6\times10^5$.

6. The liquid developing agent for electrophotography according to claim 1, wherein the dispersed resin particles are colored dispersed resin particles.

7. The liquid developing agent for electrophotography according to claim 1, wherein the dispersed resin particles are present in an amount from 0.5 to 50 parts per 1000 parts by weight of the non-aqueous solvent.

* * * * *